US008056372B2

(12) United States Patent
Jürgens et al.

(10) Patent No.: US 8,056,372 B2
(45) Date of Patent: Nov. 15, 2011

(54) KNITTING HEAD FOR A KNITTING MACHINE

(75) Inventors: Eric Jürgens, Bisingen (DE); Kurt Weiss, Frittlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/712,721

(22) Filed: Feb. 25, 2010

(65) Prior Publication Data

US 2010/0212365 A1 Aug. 26, 2010

(30) Foreign Application Priority Data

Feb. 26, 2009 (EP) ..... 09153822

(51) Int. Cl.
*D04B 9/00* (2006.01)

(52) U.S. Cl. ..... 66/8

(58) Field of Classification Search ..... 66/8, 9 B, 66/56, 1 R
See application file for complete search history.

(56) References Cited

U.S. PATENT DOCUMENTS

| | | | | | |
|---|---|---|---|---|---|
| 4,489,573 | A * | 12/1984 | Engelfried et al. | ..... | 66/8 |
| 4,608,839 | A * | 9/1986 | Tibbals, Jr. | ..... | 66/13 |
| 4,696,586 | A * | 9/1987 | Krug | ..... | 384/500 |
| 4,707,151 | A * | 11/1987 | Kaiser | ..... | 384/495 |
| 5,031,421 | A * | 7/1991 | Engelfried et al. | ..... | 66/8 |
| 5,134,863 | A * | 8/1992 | Hanna | ..... | 66/9 B |
| 5,493,876 | A * | 2/1996 | Tsuchiya | ..... | 66/8 |
| 6,145,346 | A * | 11/2000 | Hanyu et al. | ..... | 66/8 |
| 6,148,642 | A * | 11/2000 | Conti | ..... | 66/13 |
| 6,269,664 | B1 * | 8/2001 | Wang | ..... | 66/8 |
| 7,793,523 | B1 * | 9/2010 | Plasencia | ..... | 66/8 |
| 2008/0264108 | A1 | 10/2008 | Traenkle et al. | | |
| 2009/0266112 | A1 * | 10/2009 | Traenkle | ..... | 66/19 |

FOREIGN PATENT DOCUMENTS

| | | |
|---|---|---|
| AT | 395867 | 3/1993 |
| CH | 529867 | 10/1972 |
| DE | 3906773 | 6/1991 |
| EP | 0647732 | 4/1995 |
| EP | 1988196 | 5/2008 |

* cited by examiner

*Primary Examiner* — Danny Worrell
(74) *Attorney, Agent, or Firm* — Fitch Even Tabin & Flannery; Norman N. Kunitz

(57) ABSTRACT

A knitting head (11) for a circular knitting machine (1), with the knitting head comprising the complete main bearing (29) of the cylinder and being provided, on its lower end, with a standardized interface (34) for accommodation with a carrier ring (35) located on the side of the machine frame. The carrier ring (35) supports the head ring (30) along the entire circumference of said head ring, preferably by means of a continuous seating surface (36) extending around the entire circumference.

11 Claims, 3 Drawing Sheets

KNITTING HEAD FOR A KNITTING MACHINE

CROSS-REFERENCE TO RELATED APPLICATION

The present application claims the priority of European Patent Application No. 09 153 822.3, filed Feb. 26, 2009, the subject matter of which, in its entirety, is incorporated herein by reference.

BACKGROUND OF THE INVENTION

The invention relates to a knitting head for a circular knitting machine as well as to a circular knitting machine that is equipped with such a knitting head.

Circular knitting machines have basically been known from prior art as represented, for example, by publication AT 395867 B. Furthermore, publication CH 529867 A discloses the basic design of a circular knitting machine. In addition to auxiliary assemblies, knitting machines comprise machine controls and the like, basically a machine frame in which the knitting head is supported. The knitting head comprises a knitting cylinder, a knitting cam assembly and a carrier ring as well as, optionally, dials, a dial cam system and the like. The carrier ring is a large, relatively heavy and, at the same time, stiff machine component on which the knitting cylinder is rotatably supported and which carries the knitting cam assembly. In addition, the carrier ring has other functions. For example, it accommodates a driving pinion which is used to put the knitting cylinder into rotation. Furthermore, said carrier ring may comprise a manual drive for manually moving the knitting cylinder, cable guides, oil feed lines or oil passage openings, pressurized air supplies and holder elements for feeding the yarn.

Inasmuch as the knitting cylinder bearing is an integral part of the carrier ring, the knitting head must be set up and adjusted inside the knitting machine. To accomplish this, the work required for setting up the machine frame and the knitting head must be performed one after the other, thus leading to a relatively long total assembly time for the knitting machine. If the knitting head is to be replaced in a knitting mill, for example for trouble-shooting machine damage or for adjusting a knitting machine for another division or for another diameter, this is difficult in most cases, considering existing machine designs. If the knitting head is removed together with the carrier ring from the machine, a very large weight needs to be moved. Alternatively, the knitting head can be disassembled and its individual components removed from the machine. This is tedious, cumbersome and requires extraordinary professional knowledge.

Considering this, it is the object of the invention to provide an improved design that allows a reduction of the machine assembly times and a simplification of maintenance, in particular on-site maintenance.

SUMMARY OF THE INVENTION

The above object generally is achieved according to the present invention with a knitting head that no longer comprises its own carrier ring. Instead, the carrier ring is now associated with the circular knitting machine, i.e., the carrier ring is part of the machine frame. However, the knitting head has its own head ring that acts as the support of the knitting cylinder and, in turn, is connected—via a suitable, preferably standardized, interface—with the carrier ring. The head ring may be substantially slimmer and thus also lighter in weight than the conventional carrier ring. When installed, the head ring is imparted with its structural rigidity by the carrier ring that is permanently mounted to the frame. Until now, the weight of the carrier ring of up to approximately 250 kg was associated with the knitting head; now, the carrier ring is part of the machine frame. The weight of a large knitting head can thus be reduced from the present weight of approximately 600 kg to clearly lower values, for example, by 350 kg. The technology required for handling a knitting head, installing of said knitting head in the machine frame, and removing said knitting head from the machine frame can be substantially simplified as a result of this. In contrast, the heavy machine frame already requires appropriate lifting equipment for transport or assembly due to the great weight of said machine frame. The increase of the weight of the machine frame by adding the carrier ring to the machine frame plays a subordinate part, in view of the time and effort required for the manufacture, transport and installation of the knitting machine. However, the maintenance and, optionally, also the replacement of the knitting head are substantially facilitated. For example, the installation of the ball bearing located below the knitting cylinder and supporting said knitting cylinder is facilitated due to the reduced weight of the parts that are being handled.

The head ring arranged on the knitting head is not suitable as a central, (weight-)bearing element of the knitting machine. The carrier ring remains the central bearing element which now, however, no longer belongs to the knitting head. The interface between the head ring and the carrier ring is preferably provided in the form of precisely machined and optionally finely processed abutment surfaces on the head ring and on the carrier ring, said abutment surfaces being as uniform as possible for use on several types of machines. As a result of this, machine frames and/or knitting heads of different machine types may be standardized, thus lowering manufacturing costs and time.

The bearing that is disposed to support the knitting cylinder is preferably a rolling bearing with rolling elements in the form of cylindrical or tapered rollers, barrels, needles or spheres. Associated with the bearing are bearing surfaces, at least on of them being provided on the head ring and at least another one being provided on the knitting cylinder or on a cylinder carrier ring. In so doing, the bearing surface may be provided directly on the respective ring or on a corresponding element supported by the respective ring, said element being, for example a profile wire or also a round wire. Then, the respective rings have seating surfaces for the accommodation of bearing parts.

Preferably, the head ring has at least one circumscribing ring-shaped, preferably plane, abutment surface that acts as the axial abutment surface. Said abutment surface is associated with a corresponding, equal-size, preferably circumscribing, continuous uninterrupted abutment surface on the carrier ring. Due to the planar seating of the head ring on the carrier ring, the entire circumference of the head ring is uniformly supported in a stationary manner.

Furthermore, the head ring preferably has a peripheral surface having a cylindrical form, for example, which, in turn, may be associated with a corresponding surface of the carrier ring. Due to this arrangement, good centering of the head ring is achieved. It is possible to provide several ring-shaped, plane or cylindrical abutment surfaces on the head ring, as mentioned above.

Additional details of advantageous embodiments of the invention result from the drawings, the description or from the subclaims. The description is restricted to essential aspects of the invention and to miscellaneous situations. The drawings disclose additional details and are to be considered for supplementary reference.

DETAILED DESCRIPTION OF THE INVENTION

Figure 1:
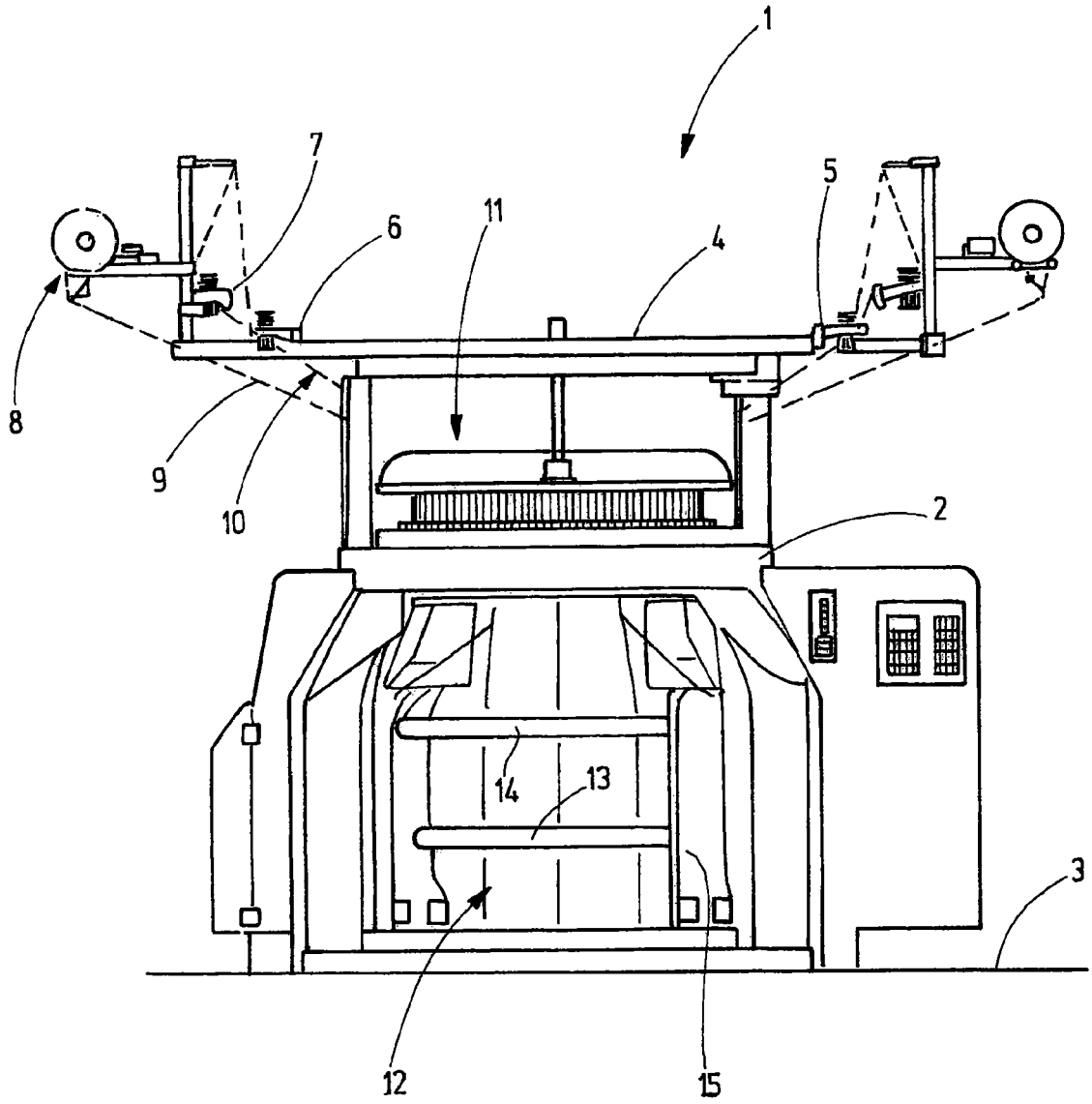
FIG. 1 is a schematized simplified side view of a circular knitting machine.

FIG. 1 shows a circular knitting machine 1. It comprises a machine frame 2 that is set on a floor 3 and supports the essential components of the knitting machine 1. At the top of the machine frame 2 is a carrier 4 for add-ons that include, for example, thread delivery devices 5, 6, 7,8. They supply each of the numerous knitting sites of the circular knitting machine 1 with respectively at least one thread 9, 10. Using these threads 9, 10 (and a large plurality of threads not shown in FIG. 1), a knitting head 11 belonging to the circular knitting machine 1 produces the desired knit goods that are wound up by a pull-off arrangement 12, for example, below the knitting head 11 in the machine frame 2. Said pull-off arrangement comprises, e.g., several horizontally arranged rolls 13, 14 that are arranged in a frame 15 rotating about a vertical axis. The frame 15 rotates about the vertical axis, preferably in synchrony with the knitting head 11.

Figure 2:
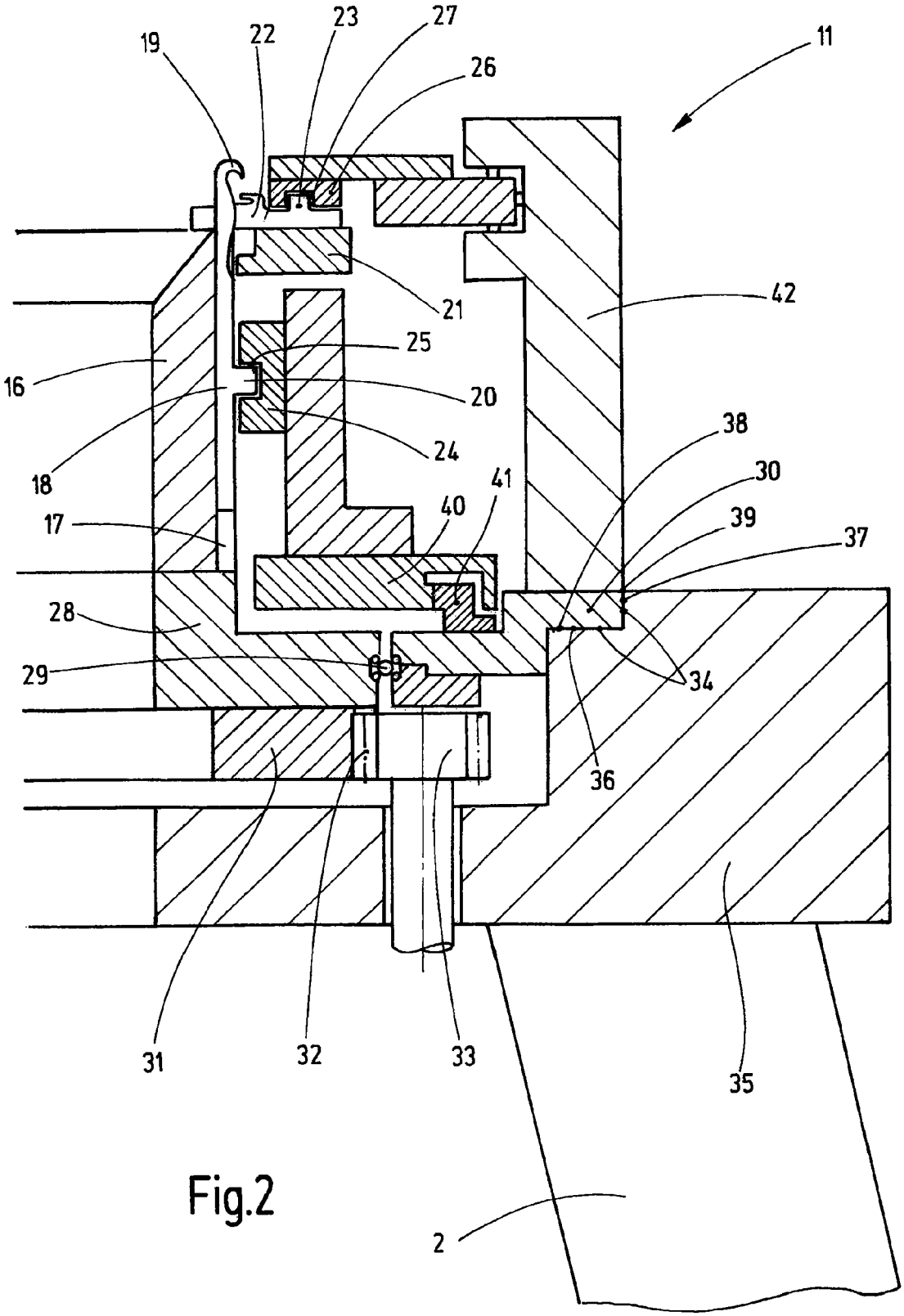
FIG. 2 is a representation of a detail, vertically in section, of the circular knitting machine in accordance with FIG. 1.

The design of the knitting head 11 is obvious, in particular from the detail of the knitting machine 1 as shown in FIG. 2. The knitting head 11 comprises a knitting cylinder, 16 that is a hollow cylinder. Vertical slit-like needle channels 17 are arranged on the outside circumference of said hollow cylinder. Supported in each needle channel 17 is respectively one knitting needle 18 that can be moved back and forth in longitudinal direction. Such a knitting needle 18 has, on its upper end, projecting from the needle channel, a hook 19 disposed to form the desired knit material. In a section remote from the hook 19, the knitting needle 18 is provided with a foot 20 that extends approximately radially away from the knitting cylinder 16 and projects from the needle channel 17.

The upper end of the knitting cylinder 16 that rotates about the vertical axis during operation is connected—at least in the present exemplary embodiment—to a ring-shaped dial 21, said dial being arranged so as to be concentric to said knitting cylinder and being provided with radial grooves. Seated in these are holding-down sinkers 22 that can move in the dial 21 in radial direction and that interact with the knitting needles 18, specifically their hooks 19, in order to produce the desired knit material. Each holding-down sinker 22 has a foot 23 that projects from the dial 21.

The knitting cylinder 16 is enclosed by an overall ring-shaped needle cam 24 that has, on its side facing the outside surface of the knitting cylinder 16 at least one guide channel 25 into which extend the foot 20 of the knitting needle 18 as well as the feet of additional knitting needles. The needle cam 24 may also comprise several guide paths 25 that are vertically offset with respect to each other, in which case groups of the knitting needles 18 then come into engagement with different guide paths.

In a similar manner, the dial 21 is associated with a sinker cam 26 that has at least one guide path 27 for the holding-down sinkers 22. The guide paths 25, 27 have a profile that is ascending and descending in longitudinal direction of the knitting needle 18 and the holding-down sinkers 22, respectively. The relative rotation between the knitting cylinder 16 and the needle cam 24 thus effects the axial driving-out and retraction movements of the knitting needle 18. In the same manner, the relative rotation between the dial 21 and the sinker cam 26 effects the radial back-and-forth movement of the holding-down sinker 22.

The knitting cylinder 16 is associated with a cylinder carrier ring 28 on which is seated the lower end of the knitting cylinder 16 and which, preferably, is arranged concentrically with respect to the knitting cylinder 16 and is permanently connected therewith. The cylinder carrier ring 28 is disposed for the rotatable support of the knitting cylinder 16 by means of a bearing 29. In addition, a head ring 30 is provided, said head ring being stationarily arranged in the circular knitting machine 1. The knitting cylinder 16 may be driven by any suitable means such as, for example, a driving ring 31 that is provided with teeth 32 on its inside or on its outside. These teeth may mesh with a pinion 33, said pinion being driven by an electric motor, for example.

Figure 3:
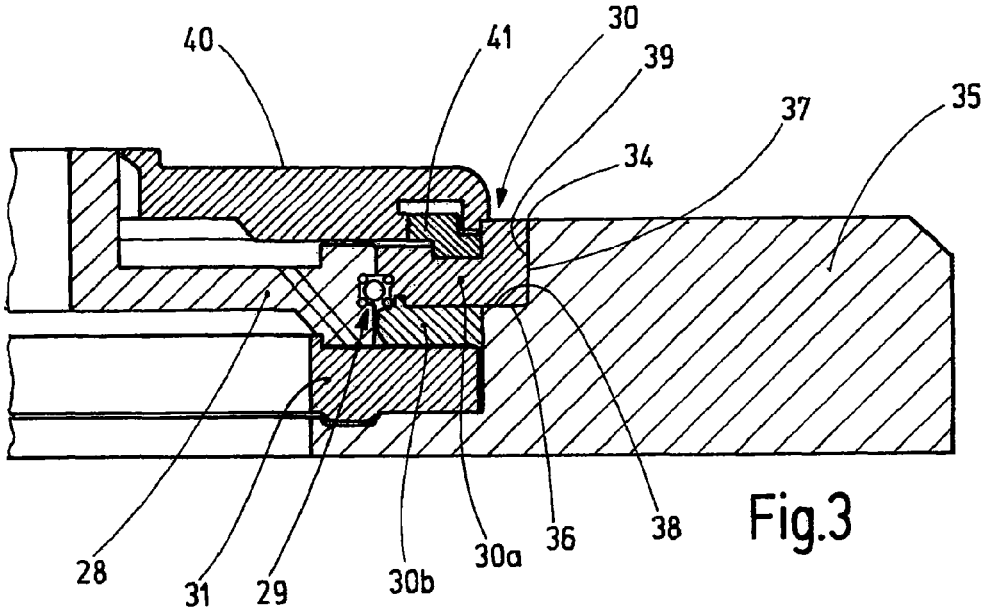
FIG. 3 is a separate sectional representation of a part of the circular knitting machine in accordance with FIG. 2.

The head ring 30 is a relatively heavy machine part that does not possess sufficient inherent rigidity in order to be connected, for example, only at points with the machine frame and still be able to hold the weight of the knitting cylinder 16. Therefore, the head ring 30 abuts against a carrier ring 35 via an appropriate interface 34, said carrier ring belonging to the machine frame 2 and being connected therewith. The carrier ring 2 absorbs the weight originating from the head ring 30 at corresponding seating surfaces 36, 37 and distributes said weight over individual struts of the machine frame 2. For example, a first seating surface 36 is conFIG-.ured as a plane annular surface, while the second seating surface may be conFIG.ured as an adjoining cylinder surface. To do so, the head ring 30 has on its lower face an abutment surface 38 and on its outside circumference a preferably cylindrical abutment surface 39 extending all round. The abutment surface 38 is uniformly seated in a planar manner on the seating surface 36. The abutment surface 39 is centered by the seating surface 37. These relationships are illustrated, in particular, by FIG. 3. The seating surfaces 36, 37 and the abutment surfaces 38, 39, together, form the interface 34. The head ring 30 represents an intermediate ring between the carrier ring 35 and the bearing 29. At the same time, said head ring supports the needle cam 24. This is accomplished with an adjustment ring 40 for the height adjustment of the needle cam 24. The adjustment ring 40 may consist of one or more parts. For example, it accommodates—on its upper part—the needle cam 24. The adjustment ring abuts against the head ring 30 via one or more adjustment elements 41, for example, in the form of a ring nut.

In the operative mode of the circular knitting machine, in which the knitting cylinder 16 is rotating, the head ring 30, the adjustment ring 40 and the needle cam 24 are inoperative. Likewise, the sinker cam 26 is inoperative. The latter may be connected via struts 42 with the head ring 30, as is obvious from FIG. 4 that shows a slightly modified embodiment. These struts 42 extend in vertical direction at several points on the circumference of the head ring 30 away from said head ring in upward direction and are connected at the top with the sinker cam 26.

Figure 5:
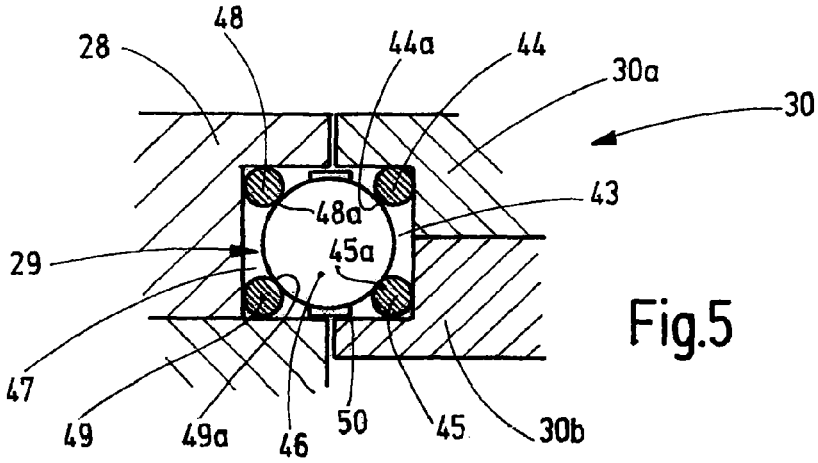
FIG. 5 is a representation of a detail, vertically in section, of the bearing of the knitting head represented by FIG. 2, said knitting head being associated with the knitting machine.

FIG. 5 shows, separately, the design of the bearing 29. As illustrated, the head ring 30 may consist of two parts and of two partial rings 30*a*, 30*b*. These define between them a ring-shaped groove-like recess 43. Suitable bearing rings may be placed in said recess, here, for example, in the form of bearing wires 44, 45, that provide bearing surfaces 44*a*, 45*a* for spherical rolling elements 46, for example.

In a similar manner, the cylinder carrier ring 28 defines a ring-shaped groove-like recess 47 located opposite the recess 43, whereby additional wires 48, 49 are arranged in said recess 47 in order to provide bearing surfaces 48*a*, 49*a* for the rolling elements 46. These may be arranged in a plastic chain 50, said chain forming a bearing cage.

Figure 4:
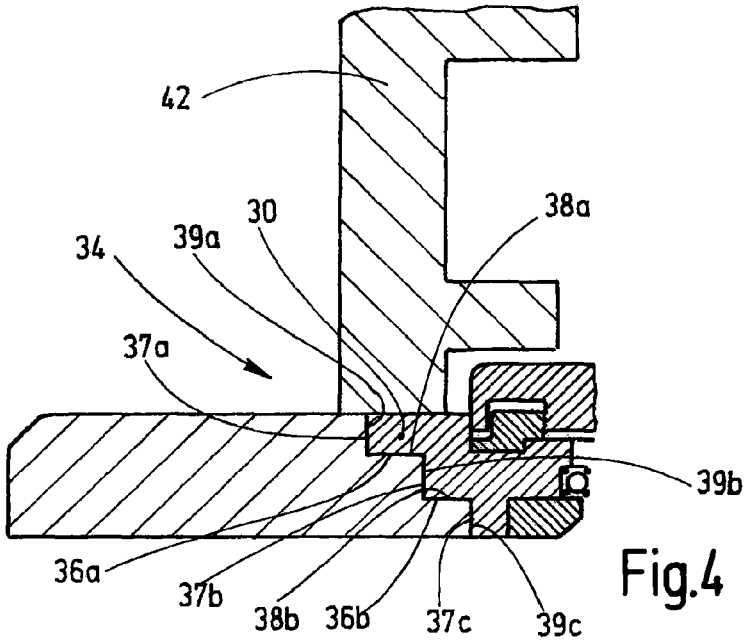
FIG. 4 is a detail, vertically in section, of another part of the circular knitting machine shown in FIG.S. 1 and 2.

As is shown by FIG. 4, the interface 34 on the head ring 30 may also have multiple steps. For example, the abutment surfaces 38, 39 may be divided into partial surfaces 38*a*, 38*b*. Likewise, the abutment surfaces 39 may be divided into corresponding partial surfaces 39*a*, 39*b*. The corresponding seating surfaces 36, 37 may be divided, accordingly, into partial surfaces. Other than that, the above description applies analogously.

The knitting machine 1 shown in FIG. 1 comprises, as described above, a knitting head 11 that is conFIG.ured as an independent assembly and ends at the interface 34. It may be separate from the carrier ring 35 and be moved out of the knitting machine 1 and replaced again in the knitting machine 1 following the same path. The replacement of the knitting head 1 is simplified compared with circular knitting machines in which the carrier ring 35 is associated with the knitting head 11. Considering the knitting machine in accordance with the invention, the bearing ring 35, as opposed to this, is associated with the machine frame 2.

As a result of the design in accordance with the invention, the knitting head 11 may be completely preassembled and adjusted, and installed in the circular knitting machine 1 at the appropriate time. Therefore, the machine frame and the knitting head may be assembled at the same time. This parallel assembly reduces the assembly time.

A knitting head 11 is conFIG.ured to be used in a circular knitting machine 1, said knitting head being provided, on its lower end, with a standardized interface 34 for accommodation with a carrier ring 35 located on the side of the machine frame. The carrier ring 35 supports the head ring 30 along the entire circumference of said head ring, preferably by means of a continuous seating surface 36 extending around the entire circumference.

It will be appreciated that the above description of the present invention is susceptible to various modifications, changes and modifications, and the same are intended to be comprehended within the meaning and range of equivalents of the appended claims.

List of reference numerals:

1 Circular knitting machine
2 Machine frame
3 Floor
4 Carrier
5, 6, 7, 8 Thread delivery devices
9, 10 Thread
11 Knitting head
12 Pull-off arrangement
13, 14 Rolls
15 Frame
16 Knitting cylinder
17 Needle channel
18 Knitting needle
19 Hook
20 Foot
21 Dial
22 Holding-down sinkers
23 Foot
24 Needle cam
25 Guide path
26 Sinker cam
27 Guide path
28 Cylinder carrier ring
29 Bearing
30 Head ring
30*a*, 30*b* Partial rings
31 Driving ring
32 Teeth
33 Pinion
34 Interface
35 Carrier ring
36, 37 Seating surfaces
38, 39 Abutment surfaces
40 Adjustment ring
41 Adjustment elements
42 Strut
43 Recess
44, 45 Wires
46 Rolling element
47 Recess
48, 49 Wires
50 Chain

What is claimed is:

1. Knitting head for a circular knitting machine, comprising;

a knitting cylinder with needle channels for knitting needles, with the knitting cylinder being mounted on a cylinder carrier ring;

a needle cam arranged to be concentric to the knitting cylinder and to circumscribe said knitting cylinder on its outside;

a bearing for the rotatable support of the knitting cylinder, wherein the bearing has at least two bearing surfaces that may be counter-rotational, with one of the bearing surfaces of the bearing being provided on the cylinder carrier ring;

a head ring that is provided with another of the bearing surfaces of the bearing so that the cylinder carrier ring is rotatably connected to the head ring by the bearing, said head ring supporting said needle cam and being connected to the needle cam via an adjustment arrangement, and said head ring is set up to be mounted in a machine frame of the circular knitting machine, and wherein the head ring is set up for mounting in a separate carrier ring belonging to the machine frame.

2. Knitting head in accordance with claim 1, wherein rolling elements are arranged between the bearing surfaces.

3. Knitting head in accordance with claim 1, wherein the head ring is divided into two partial rings that are arranged concentrically with respect to each other, said partial rings being connected to each other.

4. Knitting head in accordance with claim 3, wherein each of the partial rings has at least one bearing surface of said bearing.

5. Knitting head in accordance with claim 1, wherein the head ring has at least one ring-shaped circumscribing abutment surface for engaging a corresponding abutment surface of the separate carrier ring belonging to the frame.

6. Knitting head in accordance with claim 5, wherein the abutment surface is plane.

7. Knitting head in accordance with claim 1, wherein the head ring has at least one peripheral surface that is configured as an abutment surface for engaging a corresponding abutment surface of the separate carrier ring belonging to the frame.

8. Knitting head in accordance with claim 1, wherein the cylinder carrier ring is non-rotationally connected with the knitting cylinder.

9. Knitting head in accordance with claim 1, wherein a driving device is associated with the knitting cylinder.

10. Knitting machine comprising a knitting head in accordance with claim 1, wherein the separate carrier ring is a permanent component of the machine frame.

11. Knitting head in accordance with claim 1, wherein the head ring has an interface for mounting the head ring in the separate carrier ring including at least one ring-shaped circumscribing abutment surface and at least one peripheral abutment surface for engaging corresponding abutment surfaces of the separate carrier ring.

* * * * *